United States Patent [19]

Newton

[11] 4,218,869

[45] Aug. 26, 1980

[54] SPUN-LIKE CONTINUOUS MULTIFILAMENT YARN

[75] Inventor: Richard C. Newton, Greenville, S.C.

[73] Assignee: Phillips Petroleum Company, Bartlesville, Okla.

[21] Appl. No.: 934,669

[22] Filed: Aug. 17, 1978

[51] Int. Cl.[2] ..... D02G 1/20; D02G 3/04

[52] U.S. Cl. ..... 57/245; 57/289; 57/290; 57/350; 57/351; 57/908

[58] Field of Search ..... 57/244–247, 57/288, 350, 3, 6, 248, 289, 290, 328, 231, 351, 908; 28/247, 271

[56] References Cited

U.S. PATENT DOCUMENTS

| | | | |
|---|---|---|---|
| 3,104,516 | 9/1963 | Field, Jr. | 57/350 X |
| 3,110,151 | 11/1963 | Bunting et al. | 57/908 X |
| 3,309,855 | 3/1967 | Stoll et al. | 57/289 |
| 3,460,336 | 8/1969 | Collingwood et al. | 57/908 X |
| 3,534,540 | 10/1970 | Collingwood et al. | 57/908 X |
| 3,763,643 | 10/1973 | Buzano | 57/350 X |
| 3,824,776 | 7/1974 | London, Jr. | 57/245 X |
| 4,068,460 | 1/1978 | Fischbach | 57/288 X |
| 4,081,948 | 4/1978 | Parker | 57/288 |
| 4,110,964 | 9/1978 | Bruner | 57/290 X |
| 4,147,020 | 4/1979 | Oakes | 57/908 X |
| 4,164,117 | 8/1979 | Talbot | 57/289 |

*Primary Examiner*—Donald Watkins

[57] ABSTRACT

A process is disclosed for producing a continuous multifilament yarn of melt-spinnable, polymeric material which comprises draw-texturing first and second continuous filament yarn ends separately and then combining the yarn ends in an interlacing zone by feeding one of the yarn ends at a higher speed than the other through a jet entangler to interlace the yarns together. Also disclosed is the spun-like continuous multifilament yarn produced by the novel process.

17 Claims, 2 Drawing Figures

SPUN-LIKE CONTINUOUS MULTIFILAMENT YARN

Figure 1:
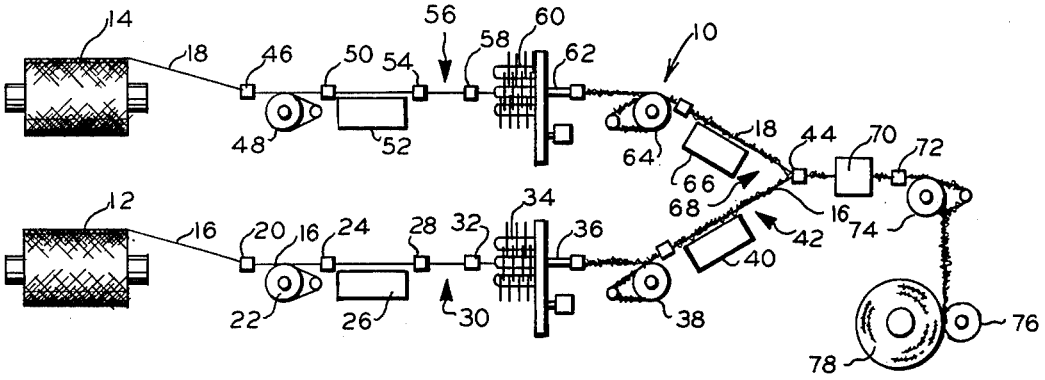

This invention relates to the production of yarn. In one aspect it relates to a novel process for the production of continuous multifilament yarn. In another aspect it relates to a novel yarn produced by the novel process.

There has been an accelerating trend toward a spun yarn look in outer wear recently, as evidenced by numerous articles in trade publications and reduced sales of continuous filament polyester. For some time, the textile industry has sought ways of producing yarns from continuous filaments such that the yarns have the characteristics of a spun yarn comprising staple fibers and can be woven into fabric having a spun yarn look. Prior to the development of synthetic filaments, all yarns were produced from staple products. Synthetic filaments, however, are manufactured in the form of continuous filaments and, in order to provide the desirable effects of staple products, a vast proportion of synthetic filament production has been cut into staple length fibers, which fibers are then twisted into yarns called spun yarns.

Spun yarns have a particularly desirable characteristic of being somewhat fuzzy along their length, giving them the desirable attributes of softness and cover and, when woven into fabrics, the ability to produce low density, porous, permeable and comfortable materials. Continuous filament yarns also have many desirable attributes but these are accompanied by limitations, particularly with respect to bulk, cover and comfort factors. It is well known, however, that continuous filament yarns have replaced spun yarns for many end uses.

It is readily apparent that, if a continuous filament yarn can be made into a spun-like yarn, the otherwise expensive yarn-producing steps of cutting continuous fibers into staple followed by opening, picking, carding, drawing and twisting into roving, followed by drafting and further twisting could be eliminated. Many attempts have been made to accomplish this feat, but various limitations in the resulting products have prevented such continuous filament yarns from completely replacing spun yarns.

It would thus be advantageous to produce a simulated spun-like yarn made from continuous filaments which provides good bulk, cover and comfort and does not have the disadvantages of the prior art.

In accordance with the present invention it has been discovered that a spun-like, continuous synthetic filament yarn, which can be woven, knitted or otherwise made into a fabric having a spun-like appearance, can be produced by combining two separately draw-textured continuous multifilament yarn ends in an interlacing zone while overfeeding one of the yarn ends at a higher speed than the other yarn end and then running the combined yarn ends through a jet entangler to interlace the yarn ends together.

It is, therefore, an object of the present invention to produce a textured continuous filament yarn of melt-spinnable polymer material with spun-like yarn appearance and feel.

It is another object of the present invention to provide a process for the production of a textured continuous filament yarn of melt-spinnable polymer material with spun-like yarn appearance and feel.

Figure 2:
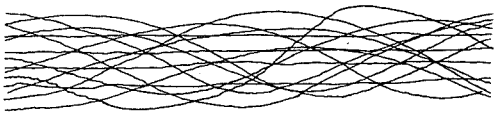

Other objects, aspects and advantages of the invention will be evident from the following detailed description and claims when read in conjunction with the accompanying drawing in which:

FIG. 1 is a schematic diagram illustrating the process of the present invention; and FIG. 2 is an enlarged diagrammatical illustration of a yarn produced in accordance with the present invention.

More specifically, in accordance with the invention there is provided a novel process for producing a continuous multifilament yarn comprising separately draw-texturing first and second continuous filament yarn ends, combining the first and second yarn ends and feeding the combined yarn ends through a jet interlacer in an overfeed condition with one draw-textured yarn end being fed at a greater rate of overfeed than that of the other yarn end. Another aspect of the present invention is the novel spun-like continuous multifilament yarn produced by the novel process.

Referring now to FIG. 1, apparatus is schematically depicted therein for the production of the continuous multifilament yarn of the present invention and is generally designated by the reference character 10. It is presently preferred to employ a Scragg SDS-II draw-texturing machine as the apparatus 10. This unit is manufactured by Ernest Scragg and Sons Limited, P.O. Box 16, Sunderland Street, Macclesfield, England.

As employed in the present manufacturing process, the apparatus 10 includes a creel structure (not shown) which will simultaneously accommodate at least two yarn supply packages 12 and 14. The packages 12 and 14 supply first and second component yarn ends 16 and 18, respectively, to the apparatus 10. Yarn end 16 is directed through a suitable guide 20 to an input feed roll system 22, from the feed roll system 22 through a guide 24 over a first heater 26, and thence through a guide 28 into a cooling zone 30. From the cooling zone 30, the yarn end 16 moves through a guide 32 and continues through a multi-disc friction-false-twist unit or friction aggregate 34 of the general type described and illustrated in U.S. Pat. No. 3,885,378 where the yarn end 16 is false-twisted. The presently preferred friction-twist unit is known under the registered trademark Positorq of Ernest Scragg and Sons, Limited and is well known to those skilled in the yarn friction-false-twisting art.

The false-twisted yarn end 16 is directed from the friction-twist unit 34 through a guide tube 36 to an intermediate feed roll or draw roll system 38. From the draw roll system 38, the friction-twisted yarn end 16 passes directly over a final heater block 40 and through the second cooling zone 42 and then through guide 44.

The yarn end 18 is directed from the package 14 through a guide 46 to an input feed roll system 48, from the feed roll system 48 through guide 50 and over a heater 52 and then through a guide 54 into a cooling zone 56. From the cooling zone 56, the yarn end 18 moves through a guide 58 and continues through a second multi-disc friction-false-twist unit 60 which can be identical to or different from the friction-false-twist unit 34, where the yarn end 18 is false-twisted.

The false-twisted yarn end 18 is directed from the friction-twist unit 60 through a guide tube 62 to an intermediate feed roll or draw roll system 64. From the draw roll system 64, the friction-twisted yarn end 18 passes directly over a final heater block 66 and through a cooling zone 68 and then, together with the yarn end 16, through the guide 44. The heater block 40 and the cooling zone 42 comprise a relaxation zone for the false-twisted yarn end 16 intermediate the draw roll system 38 and the guide 44, while the heater block 66 and the cooling zone 68 comprise a relaxation zone for the false-twisted yarn end 18 intermediate the draw roll system 64 and the guide 44.

As the yarn ends 16 and 18 simultaneously pass through the guide 44 they are combined together before passing through an entanglement zone in the form of a jet entangler 70 and thence through a guide 72 into an output roll system 74. From the output roll system 74, the combined and interlaced yarn ends 16 and 18 are directed as a composite final yarn to a yarn winding head 76 where the composite yarn is wound onto a suitable takeup tube to form a yarn package 78.

The first and second component yarn ends 16 and 18 can be any suitable continuous multifilament yarns, but the yarns are preferably continuous multifilament yarns formed of any suitable melt-spinnable polymeric material. The presently preferred melt-spinnable polymeric material is polyethylene terephthalate, however it will be understood that either or both of the component yarns can be formed of any other suitable melt-spinnable polymeric materials, for example, one or more selected from the group consisting of polyesters, polyamides, polyolefins, and mixtures of any two or more thereof, or the like. The first and second yarn ends 16 and 18 can be supplied in any suitable form, but they are preferably supplied in the form of partially oriented continuous multifilament yarns of polyethylene terephthalate. Yarns suitable for the first and second component yarn ends 16 and 18 can be produced at any suitable spinning speeds, but the spinning speed will generally be above about 900 meters per minute, while polyethylene terephthalate or polyester yarns suitable for the yarn ends 16 and 18 are preferably spun at at least about 2400 meters per minute. The denier of each of the component yarns 16 and 18 can be of any suitable value, but the denier of each of the component yarns is preferably in the range of from about 240 to about 1000. The deniers of the first and second component yarns 16 and 18 can be identical or can differ one from the other.

The first partially oriented yarn end 16 is directed from the yarn supply package 12 over the first heater 26 which can be maintained at any suitable temperature, but the temperature of the heater 26 is generally maintained at a temperature of from about 140° C. to about 230° C. When draw-texturing a polyester yarn end 16, the heater 26 is preferably maintained at a temperature in the range of about 210° C. to about 220° C., and is more preferably approximately 215° C. The draw ratio of the first yarn end 16 can be of any suitable value, but the draw ratio is generally within the range of from about 1.5 to about 4. The draw ratio for a polyester yarn end 16 is preferably in the range from about 1.5 to about 2.0, and is more preferably approximately 1.87. The draw ratio referred to herein is the ratio of the linear speed of the draw roll system 38 to the linear speed of the input feed roll system 22. The ratio of the peripheral speed of the twisting device 34 to the yarn speed through the apparatus 10 can be of any suitable value, but this ratio is generally within the range of from about 1.59 to about 1.86, and is preferably approximately 1.71. The final heater block 40 can be maintained at any suitable temperature, but the temperature of the heater block 40 is generally maintained at a temperature of from about 140° C. to about 220° C. When draw-texturing polyester yarn, the heater block 40 is preferably maintained at a temperature in the range of about 195° C. to about 205° C., and more preferably approximately 200° C.

The second partially oriented yarn end 18 is directed over the heater 52 which can be maintained at any suitable temperature, but the temperature of the heater 52 is generally maintained at a temperature of from about 140° C. to about 230° C. When draw-texturing polyester yarn, the heater 52 is preferably maintained at a temperature in the range of about 210° C. to about 220° C. and is more preferably approximately 215° C. The draw ratio of the second yarn end 18 can be of any suitable value, but the draw ratio is generally within the range of from about 1.5 to about 4. The draw ratio for a polyester yarn end 18 is preferably in the range from about 1.5 to about 2.0, and is more preferably approximately 1.87. The draw ratio referred to for the yarn end 18 is the ratio of the linear speed of the draw roll system 64 to the linear speed of the input feed roll system 48. The ratio of the peripheral speed of the twisting device 60 to the yarn speed through the apparatus 10 can be of any suitable value, but this ratio is generally within the range of from about 1.59 to about 1.86, and is preferably approximately 1.71. The final heater block 66 can be maintained at any suitable temperature, but the temperature of the heater block 66 is generally maintained at a temperature of from about 140° C. to about 220° C. When draw-texturing polyester yarn, the heater block 66 is preferably maintained at a temperature in the range of about 195° C. to about 205° C., and more preferably approximately 200° C.

The stabilizing overfeed or letback of the friction-twisted, draw-textured yarn end 16 in the relaxation zone between the draw roll system 38 and the output roll system 74 can be of any suitable value, but is generally within the range of from about 10 percent to about 25 percent, is preferably in the range from about 11 percent to about 13 percent, and is more preferably approximately 11.8 percent. The stabilizing overfeed or letback of the friction-twisted, draw-textured yarn end 18 in the relaxation zone between the draw roll system 64 and the output roll system 74 can be of any suitable value, but is generally within the range of from about 15 percent to about 25 percent, is preferably in the range from about 18 percent to 20 percent, and is more preferably approximately 19.1 percent. In any case, the overfeed or letback of the yarn end 18 exceeds the overfeed or letback of the yarn end 16 by a suitable amount, generally this amount is in the range from about 3 percent to about 15 percent, and preferably in the range from about 5 percent to about 9 percent.

It will be seen that the apparatus 10 permits the simultaneous draw-texturing of the yarn ends 16 and 18 immediately prior to their introduction into a common interlacing or entanglement zone and their subsequent mutual jet entanglement to form a final composite spun-like continuous multifilament yarn.

The following example is illustrative of a preferred embodiment of the present process.

EXAMPLE I

A first continuous multifilament 290/34 component yarn end (290 denier, 34 filaments), partially oriented polyethylene terephthalate was fed from a supply package at about 149 meters per minute by the input feed roll system at a first position of a Scragg SDS-II friction-texturing machine using a Scragg Positorq friction-twist unit, over a primary heater at a temperature of about 215° C. and then through a cooling zone to said friction-twist unit. The draw-textured first component yarn end was withdrawn from the friction-twist unit at about 279 meters per minute by a draw roll system and was directed therefrom through a final heater at a temperature of about 200° C. and then through a cooling zone, a jet entangler and an output roll system operating at about 246 meters per minute. The jet entangler was provided with a yarn passage bore about 0.625 in. (15.9 mm.) in length and about 0.156 in. (3.96 mm.) in diameter. The bore was intersected by two air jet passages perpendicular to the bore with a 60 degree included angle therebetween. Each air jet passage had a diameter of about 0.062 in. (1.57 mm.) and a length of about 0.118 in. (3.0 mm.). Simultaneously, a second continuous multifilament 290/34 component yarn end (290 denier, 34 filaments), partially oriented polyethylene terephthalate was fed from a supply package at about 162 meters per minute by the input feed roll system at a second position of said Scragg SDS II friction-texturing machine using a second Scragg Positorq friction-twist unit, over a primary heater at a temperature of about 215° C. and then through a cooling zone to said second friction-twist unit. The draw-textured second component yarn end was withdrawn from the second friction-twist unit at about 304 meters per minute by a draw roll system at the second position and was directed therefrom through a final heater at a temperature of about 200° C., and then through a cooling zone, said previously mentioned jet entangler, and said previously mentioned output roll system operating at about 246 meters per minute. The first and second component yarn ends were continuously combined in a guide ahead of a jet entangler and then interlaced or entangled in the jet entangler. The entangled resulting final composite yarn was then continuously withdrawn from the jet entangler by said output roll system and subsequently wound onto a takeup tube to form a yarn package. The formation of the resulting final composite yarn was achieved under the following conditions:

Friction-twist unit employed at each position: Scragg Positorq® with 12 disc ceramic friction twisters and 35.5 millimeter center spacing;

Throughput speed (measured at output roll 74): 246±5 meters per minute;

D/Y ratio (peripheral speed of friction discs to linear yarn speed at each position): about 1.71;

Overfeed of first yarn end between first position draw roll system and output roll system: about 11.8 percent;

Overfeed of second yarn end between second position draw roll system and output roll system: about 19.1 percent;

Draw ratio (ratio of draw roll system linear speed to input feed roll system linear speed for both first and second yarn ends): 1.87;

Entangling: air jet entangler at about 30 psig air pressure;

Tension on each yarn end immediately preceding passage through the respective friction-twist unit: about 40 grams;

Tension of each yarn end immediately after passage through the respective friction-twist unit: about 42 grams; and Winder tension: 100±10 grams.

The composite final yarn was 310/68 (310 denier, 68 filaments). The yarn was similar to single end false-twist textured yarn in stretch properties. The yarn was spun-like when tensioned without filament elongation in that the shorter, underfed first yarn end was substantially straight and the longer, overfed second yarn end maintained its loopy appearance. The yarn provided good bulk and cover.

While the example illustrates the utilization of the present process with polyethylene terephthalate yarns, it should be understood that other thermoplastic, friction-twist texturable yarns can also be used with corresponding good results in the process of the present invention. Such yarns can be used in combination with polyethylene terephthalate yarns or in other combinations.

While the invention has been described more particularly with reference to a preferred embodiment, it is recognized that various changes can be made without departing from the spirit and scope of the invention as defined and limited only by the following claims.

What is claimed is:

1. A process for producing a continuous multifilament yarn comprising combining and mutually interlacing a plurality of draw-textured yarn ends in an interlacing zone at different overfeed speeds so as to produce a composite continuous multifilament yarn of spun-like appearance and feel.

2. A process for producing a continuous multifilament yarn comprising:

draw-texturing a first continuous multifilament yarn end;

draw-texturing a second continuous multifilament yarn end;

feeding the thus draw-textured first yarn end into an interlacing zone at a first speed;

feeding the thus draw-textured second yarn end into said interlacing zone at a second speed in excess of said first speed;

combining and interlacing said draw-textured first and second yarn ends together in said interlacing zone so as to produce a final continuous multifilament yarn having the appearance and feel of a yarn spun from staple fibers.

3. A process as defined in claim 2 wherein said first yarn end is draw-textured by:

heating said partially oriented first yarn end;

drawing the thus heated first yarn end;

cooling the thus drawn first yarn end;

friction-texturing the thus cooled first yarn end; and reheating the thus textured first yarn end; and wherein said second yarn end is draw-textured by:

heating said partially oriented second yarn end;

drawing the thus heated second yarn end;

cooling the thus drawn second yarn end;

friction-texturing the thus cooled second yarn end; and reheating the thus textured second yarn end.

4. A process as defined in claim 2 wherein said combining and interlacing step includes feeding said draw-textured first and second yarn ends through an air jet entangler so as to interlace at least a portion of the filaments of said second yarn end among at least a portion of the filaments of said first yarn end.

5. A process as defined in claim 2 or claim 3 wherein said first and second yarn ends are simultaneously draw-textured.

6. A process as defined in claim 1 or claim 2 wherein each of said yarn ends is formed of melt-spinnable polymeric material.

7. A process as defined in claim 1 or claim 2 wherein each of said yarn ends is formed of polyethylene terephthalate.

8. A continuous multifilament yarn produced in accordance with the process of claim 1.

9. A yarn as defined in claim 8 wherein each of said yarn ends is formed of melt-spinnable polymeric material.

10. A yarn as defined in claim 8 wherein each of said yarn ends is formed of melt-spinnable polymeric material selected from the group consisting of polyesters, polyamides, polyolefins and mixtures of any two or more thereof.

11. A yarn as defined in claim 8 wherein all of said yarn ends are formed of the same melt-spinnable polymeric material.

12. A yarn as defined in claim 9 wherein all of said yarn ends are formed of polyethylene terephthalate.

13. A continuous multifilament yarn produced in accordance with the process of claim 2.

14. A yarn as defined in claim 13 wherein each of said first and second yarn ends is formed of melt-spinnable polymeric material.

15. A yarn as defined in claim 13 wherein each of said first and second yarn ends is formed of melt-spinnable polymeric material selected from the group consisting of polyesters, polyamides, polyolefins and mixtures of any two or more thereof.

16. A yarn as defined in claim 13 wherein both of said yarn ends are formed of the same melt-spinnable polymeric material.

17. A yarn as defined in claim 14 wherein both of said yarn ends are formed of polyethylene terephthalate.

* * * * *